United States Patent [19]

Osborne

[11] 4,089,417

[45] May 16, 1978

[54] FLAP LOCK BULK BIN

[75] Inventor: Edward L. Osborne, Kansas City, Kans.

[73] Assignee: Westvaco Corporation, New York, N.Y.

[21] Appl. No.: 818,290

[22] Filed: Jul. 25, 1977

[51] Int. Cl.[2] ..... B65D 19/34

[52] U.S. Cl. ..... 206/600; 108/56.1; 229/5.5; 229/23 A; 229/43

[58] Field of Search ..... 217/43 A; 108/55.1, 108/55.3, 56.1, 56.3; 229/23 R, 23 A, 43, 45 R, 38, 5.5; 206/386, 600, 597

[56] References Cited

U.S. PATENT DOCUMENTS

| | | | |
|---|---|---|---|
| 2,315,094 | 3/1943 | Rehfield et al. | 229/38 |
| 2,483,063 | 9/1949 | Ray | 229/43 |
| 2,726,803 | 12/1955 | Ketler | 229/5.5 |
| 2,736,486 | 2/1956 | Rabby | 229/43 |
| 2,944,725 | 7/1960 | Hayes | 229/43 |
| 3,115,292 | 12/1963 | Repking | 229/45 |
| 3,423,008 | 1/1969 | Mykleby | 229/45 |
| 3,738,563 | 6/1973 | Eifrid | 229/41 C |
| 4,013,168 | 3/1977 | Bamburg et al. | 229/23 A |
| 4,019,635 | 4/1977 | Boots | 229/23 A |

*Primary Examiner*—Steven E. Lipman
*Assistant Examiner*—Bruce H. Bernstein

[57] ABSTRACT

An improved heavy duty, octagonally shaped bulk container is disclosed which is preferably used with a pallet. The container comprises a tubular body portion with a plurality of outer side walls having upper and lower flaps foldably attached to the ends thereof. The end flaps are selectively folded inwardly and locked into either a rectangular or octagonally shaped end closure. The end closures are prepared from flat sheets that are cut and scored for either the rectangular end or octagonal end closure configurations. The container further includes an inner liner member that is cut and scored to correspond to the octagonal shape of the container and a pair of upper and lower end reinforcing panels.

2 Claims, 11 Drawing Figures

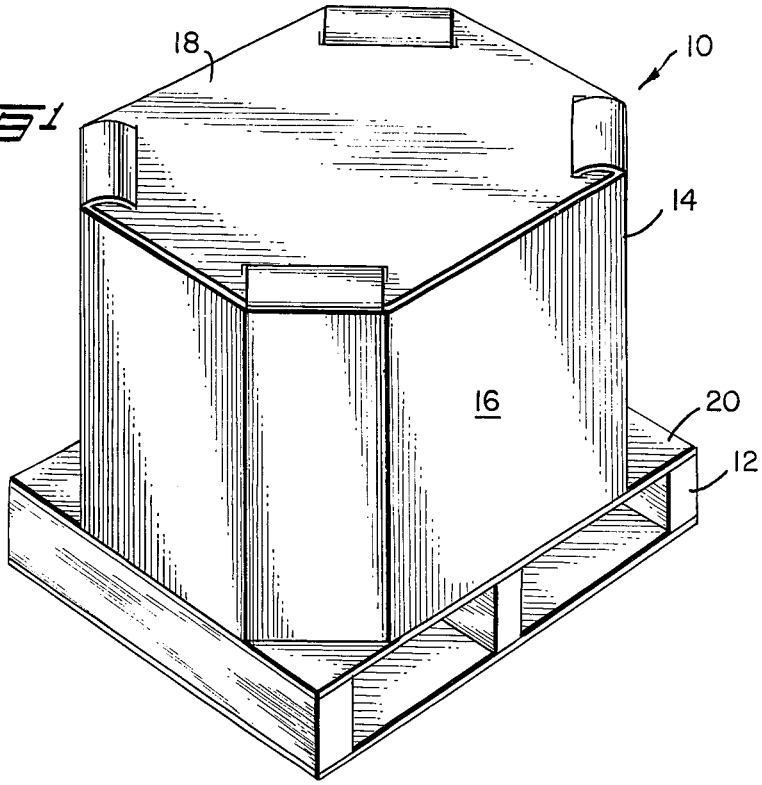
FIG 1
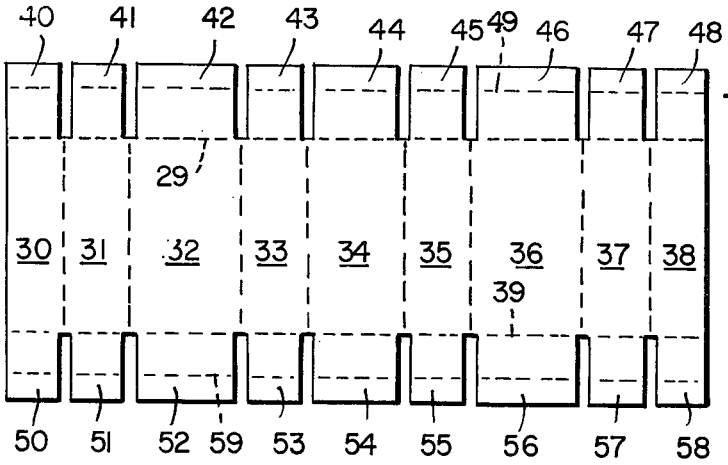
FIG 2.
FIG 4.
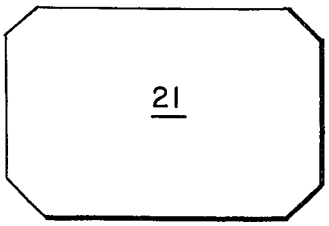
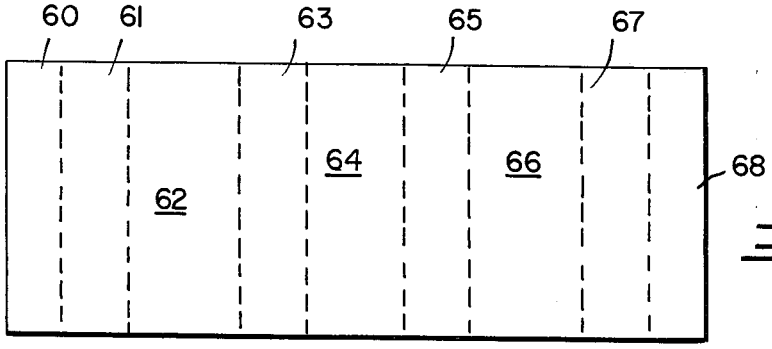
FIG 3.

FLAP LOCK BULK BIN

BACKGROUND OF THE INVENTION

This invention relates generally to shipping containers of the bulk bin type and more particularly to a bulk bin shipper that is used in connection with a pallet and which does not require strapping of the end caps to the body portion.

In the packaging of bulk materials such as Beef and Pork or granular products, it is convenient to package the products in a container that is already resting on a pallet or the like for easy handling. Moreover, since the products are generally placed in a plastic bag or the like inside the bulk container, it is not always necessary to strap the containers for shipment. However, where the containers are not strapped, the end closures must be strong enough to withstand the normal handling and stacking loads during shipment. Moreover, in order to achieve adequate stacking strength, bulk bin type containers are generally designed in other than a rectangular shape, such as for example an octangular shape, which presents problems with the formation of strong end caps utilizing standard end flaps on the container side walls.

U.S. Pat. No. 4,013,168 (206–386) shows one example of an octagonal bulk bin type container mounted on a pallet. However, the container only has closure flaps at its lower end, and those closure flaps are not locked into the lower end cap. Moreover, the top end cap is formed from a pre-cut blank that only fits around the side walls of the container body. And finally, the flat sheet which forms the lower end of the container is preferably stapled directly to the pallet.

SUMMARY OF INVENTION

In order to overcome some of the problems inherent in the prior art bulk bin type shipping containers, and to reduce the inventory required for the user of such containers, the subject invention provides a new and improved octagonal bulk bin which can be alternatively used with two octagonal end caps, two rectangular end caps or a combination of one octagonal and one rectangular end cap.

The various components of the container of the present invention are cut and scored from corrugated paperboard or the like and the blanks are shipped to the user in flat condition. The body portion of the container is formed from a substantially rectangularly shaped blank that is divided by score lines into its preferred octagonal configuration. The score lines define eight side walls of which there are four primary side walls connected to one another by four secondary or corner side walls. Each of the side walls also has attached at each end thereof, a separate end closure flap. The end closure flaps are preferably symmetrical in size and shape to one another and each includes a score line that substantially bisects the closure flap into two equally sized portions. The container further includes an inner liner member which is formed from a substantially rectangularly shaped blank including score lines like the body portion of the container but without end closure flaps. Each of the side walls of the inner liner are slightly smaller in width than the corresponding side walls of the outer body portion so as to permit the insertion of the inner liner member inside the walls of the outer body. In addition, two inside pads are preferably provided for the container, each of which is cut from a blank of the same material as the container in the general octagonal shape of the container. Meanwhile, the end caps for the bulk bin container of the present invention are each prepared from flat blanks of generally rectangular construction.

The end caps are generally referred to as side locked caps and corner locked caps. The side locked caps retain their generally rectangular shape after being locked into the end closure flaps of the outer body side walls, while the corner locked caps assume the generally octagonal shape of the container when they are locked into the end closure flaps of the outer body side walls. The perimetrical dimensions of the side locked caps are generally equal to those of the four primary side walls of the container. Thus, the corner portions of the side locked caps extend beyond the octagonal edges of the container at each corner thereof. In addition, the side locked caps include slots or slitted areas that are inset from and parallel to the side edges thereof for accepting and locking therein the end closure flaps attached to the primary side walls of the outer body. The slots or slits are dimensioned so as to accept the adjacent end closure flaps with a tight fit, while the scores therein permit the flaps to be bent for insertion in a slit or slot. The inserted portions of the flaps are held in place by an inside pad and the product packaged in the container.

The corner locked caps are also generally equal in dimension to the four primary side walls of the container, except that each corner thereof includes a score line that is located to coincide with an octagonal edge along the corner side wall of the container. In addition, the blanks from which the corner locked caps are cut include slots or slits that are inset from and parallel to each score line for accepting and locking therein the end closure flaps attached to the four secondary side walls of the outer body portion. The slots or slits are dimensioned so as to accept the adjacent end closure flaps with a tight fit and the inserted portions thereof are held in place by an inside pad member and the product packaged in the container. Thus, it may be seen that the bulk bin container of the present invention includes locking end caps at each end thereof wherein either a rectangular or octagonal end closure can be used. The blank which forms the main body portion of the container is symmetrical at each end to accommodate either two side locked end caps, two corner locked end caps or one of each. In the preferred embodiment, where the container is used on a pallet or the like, a rectangular side locked end cap is generally used as the container bottom, and the perimetrical dimensions of the cap are substantially equal to those of the pallet. Meanwhile, either another rectangular side locked cap can be used at the top end of the container or a more streamlined octagonal corner locked cap.

DESCRIPTION OF DRAWINGS

FIG. 1 is a perspective view of the bulk bin container of the present invention with a side locked end cap on the bottom and a corner locked end cap on the top;

FIG. 2 is a plan view of a typical blank from which the outer body portion of the container is formed showing the symmetrical shape and orientation of the container end closure flaps;

FIG. 3 is a plan view of the inner liner used in forming the bulk bin container of the present invention;

FIG. 4 is a plan view of a typical inside pad for the bulk bin container;

DETAILED DESCRIPTION

Figure 5:
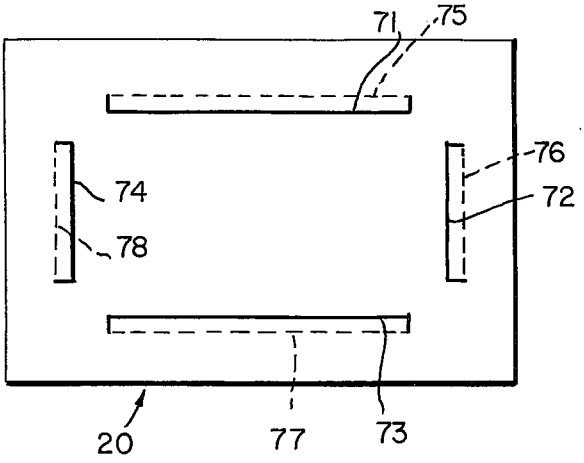
FIG. 5 is a plan view of the blank used for making a side locked end cap.

The combination bulk bin/pallet shown in FIG. 1 generally by the numeral 10 includes a pallet 12 either of the wooden or corrugated type known in the pallet trade, and, a bulk bin container 14 which includes at least an octagonally shaped outer body portion 16, an octagonally shaped top end cap 18 and a rectangularly shaped bottom end cap 20. The bulk bin may also have inserted therein an inner liner member, shown in blank form in FIG. 3 and in the exploded perspective view of FIG. 11, and a pair of inside pads 21 shown in blank form in FIG. 4 and also in the exploded perspective view of FIG. 11. The inner liner member 22 provides additional stacking strength to the bulk bin while the inside pads 21 when positioned adjacent the top and bottom of the container provide protection to the packaged product and also aid in keeping the locking flaps for the end caps in their locked position.

FIG. 2 illustrates a typical blank structure for the bulk bin outer body portion. As will be seen, the blank is symmetrical in all respects with top and bottom end closure flaps foldably attached to the outer body side walls. For convenience only, the blank is illustrated as having a plurality of side wall panels 30–38 separated from one another by a plurality of score lines. When the blank is folded and glued together to form its octagonal shape, panels 30 and 38 together form one primary side wall with panels 32, 34 and 36 forming the remaining primary side walls and panels 31, 33, 35 and 37 form the four secondary or corner side walls thus giving the bulk bin its octagonal shape. Attached to one end (top end) of the side walls 30–38 are a plurality of top closure flaps 40–48 along fold line 29, and at the other end (bottom end), are a plurality of bottom closure flaps 50–58 attached to the side walls 30–38 along a fold line 39. Each of these flaps are more or less bisected by continuous score lines 49, 59 which aid in flexing the flaps when the flaps are locked into the top and bottom end caps. As in the case of the panels 30 and 38, flaps 40, 48 and 50, 58 are adhered together to form the manufacturer's joint for the outer body portion. Obviously, instead of joining two side wall portions to form a single side wall, the blank could be provided with a single glue flap attached to one side wall and adhered to another side wall as desired.

When the bulk bin is used with an inner liner member, depending upon the type of product packaged, the needed stacking strength, etc., the inner liner 22 shown in blank form in FIG. 3 would be adhered together substantially as described above in connection with the outer body portion. For this purpose, the inner liner 22 includes a plurality of side walls 60–68 which have slightly smaller width dimensions than the primary side walls 30–38 but substantially the same length dimensions. When formed as described, the outer body portion 16 and inner liner 22 are preferably fabricated from corrugated paperboard or the like which can be coated with protective coating to provide vermin proof or water impervious outer surfaces.

The rectangular end cap or side locked end cap shown in blank form 20 in FIG. 5 is designed generally for use on the bottom of the bulk bin in conjunction with a pallet. For this purpose, the perimetrical dimensions of the blank 20 are substantially equal to those of the pallet and to the exterior dimensions of the bulk bin outer walls. It is possible, however, to use the rectangular end cap 20 at both the top and bottom of the bulk bin if desired. For this purpose, the end cap 20 includes four slots or slits 71, 72, 73, 74 located inboard of its respective four sides. The slots or slits 71, 72, 73 and 74 are of a length substantially equal to the width of the closure flaps attached to the four primary side walls of the outer body portion 16, and are cut in end cap 20 for accommodating the adjacent closure flaps of the outer body portion wherein they are inserted to lock the end cap to an end of the outer body of the bulk bin. The cuts are formed generally in a U-shape to accommodate the thickness of the blank material and score lines 75, 76, 77 and 78 preferably provided between the ends of each U-shaped cut to allow the blank material to be folded out of the way when the end closure flap is inserted therein. When the openings 71, 72, 73, 74 are formed as slots, the blank is also cut along the score lines 75, 76, 77 and 78 so the blank material can be removed.

Figure 7:
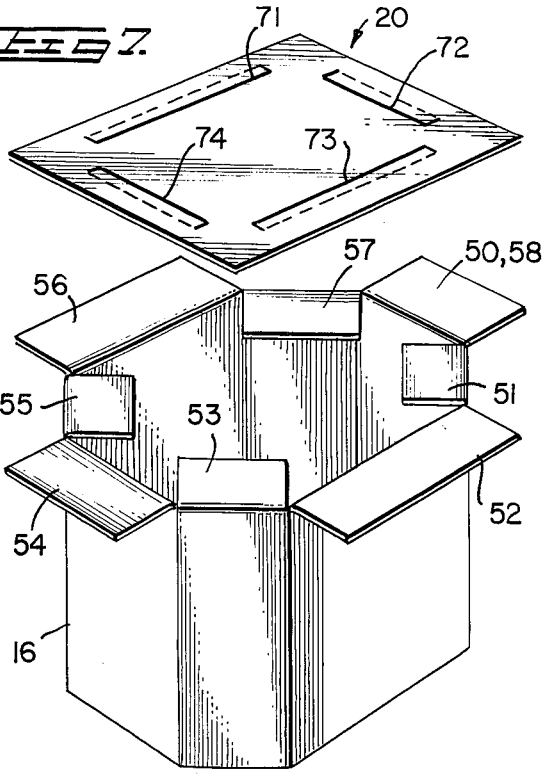
FIG. 7 is an exploded perspective view showing the first folding sequence for applying a side locked end cap to the container.
Figure 8:
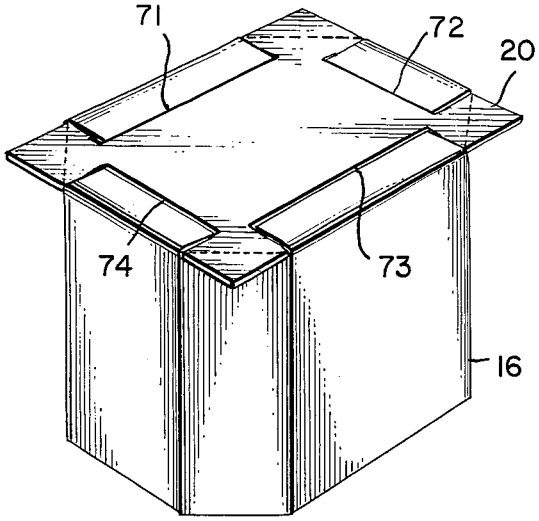
FIG. 8 shows the side locked end cap in place.

FIGS. 7 and 8 show the folding sequence and method for inserting the end closure flaps into the slots or slits at 71–74. For purpose of explanation only, FIGS. 7 and 8 show the formation of a typical bottom end cap. Note that the corner or secondary end flaps 51, 53, 55 and 57 are initially folded over and inside the outer body member 16 before the end cap 20 is placed in position. Subsequently, the primary end flaps 52, 54, 56 and 50, 58 are folded around the side edges of the end cap 20 and inserted in the slits 73, 74, 71 and 72 respectively. In order to get the end flaps into their respective slits, the slits are forced open by bending the blank material along the fold lines 77, 78, 75 and 76, and, the flaps are broken slightly along their continuous score line 59. After the end cap is locked onto the outer body portion 16, the bulk bin is turned over and placed on a pallet. The pre-formed inner liner 22 is placed inside the outer portion 16 and inside pad 21 is placed in the container to overlie the infolded closure flaps. Depending upon the product packaged in the bulk bin, a plastic bag can also be placed inside the container for holding the product.

Figure 6:
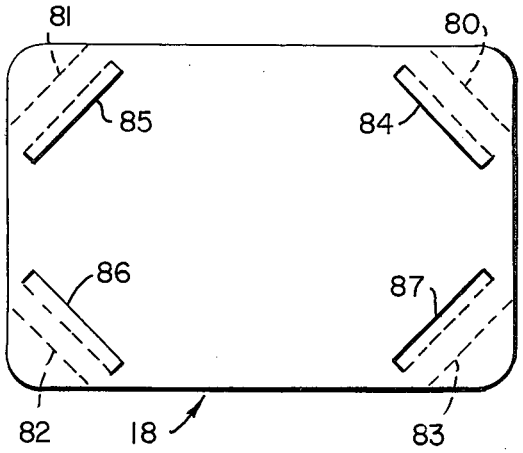
FIG. 6 is a plan view of the blank used for making a corner locked end cap.

FIG. 6 illustrates a typical octagonally shaped end cap or corner locked cap 18 designated generally for use on the top of the bulk bin, although as pointed out hereinbefore, either end cap can be used on either end of the container. The corner locked cap 18 is formed from a generally rectangular shaped blank and includes four corner scores 80, 81, 82 and 83 that correspond in location on the blank to the secondary or corner side walls 31, 33, 35 and 37 of the outer body portion 16. In addition, the corner locked cap blank 18 includes a plurality of slots or slits 84, 85, 86 and 87 that are offset from and inboard of the score lines 80, 81, 82 and 83 for accomodating the end closure flaps attached to the secondary or corner side walls 31, 33, 35 and 37. These slots or slits are formed substantially like the corresponding slots or slits in the side locked end caps and have a length substantially equal to the width of the flaps attached to the side walls 31, 33, 35 and 37.

Figure 9:
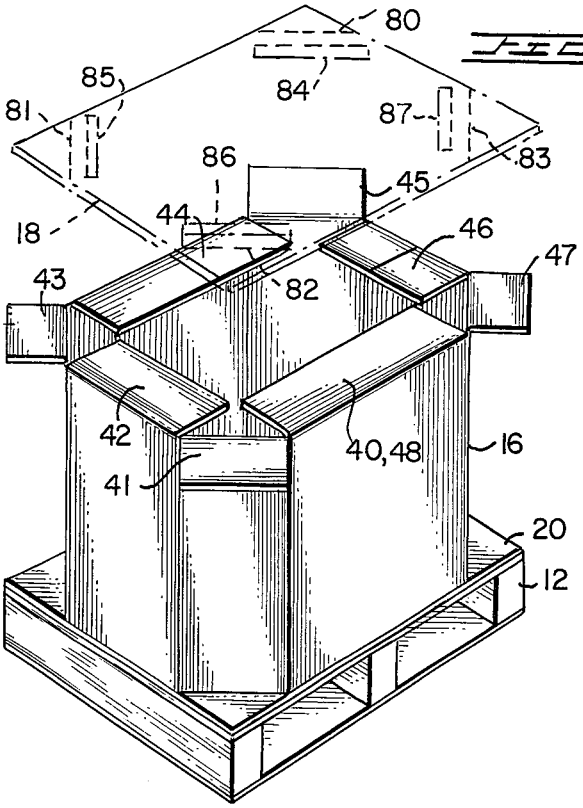
FIG. 9 is an exploded perspective view showing the first folding sequence for applying a corner locked end cap to the container.
Figure 10:
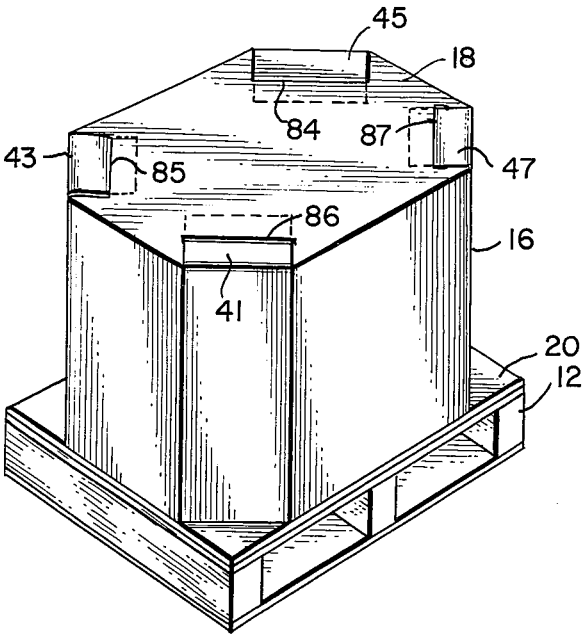
FIG. 10 shows the corner locked end cap in place.
Figure 11:
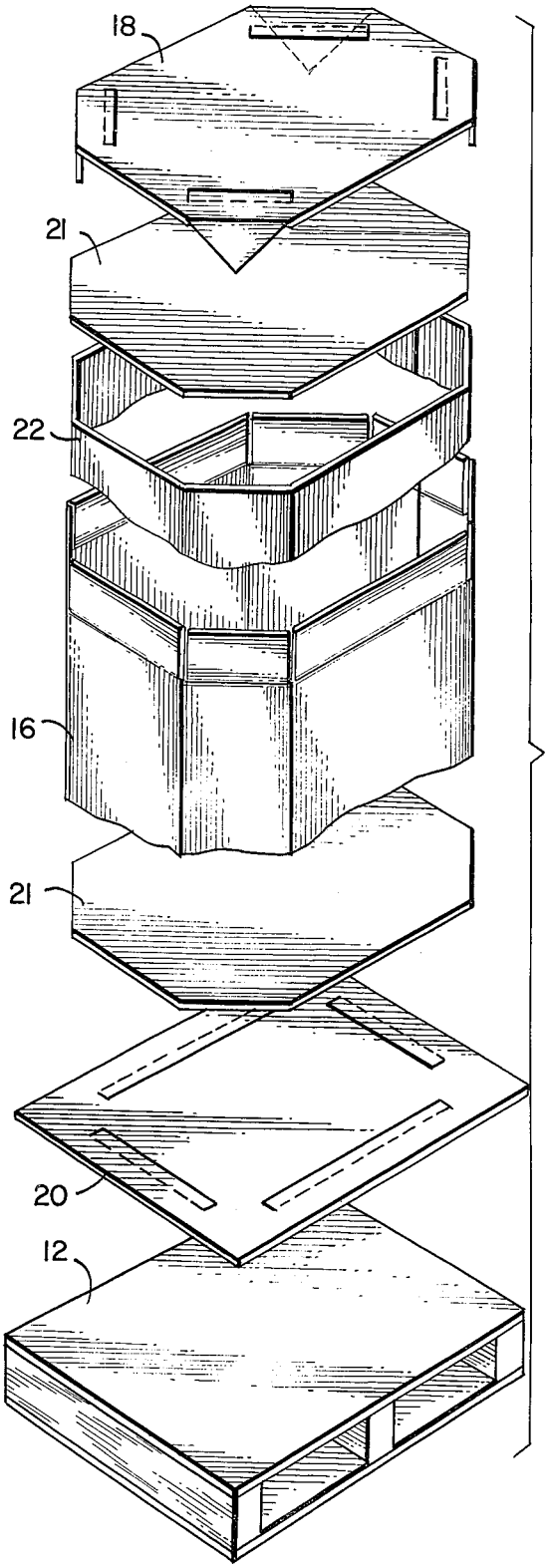
FIG. 11 is an exploded perspective view showing the component parts and their relationship for preparing the bulk bin/pallet combination shown in FIG. 1.

FIGS. 9 and 10 show the folding sequence and method for attaching the corner locked end cap 18 to the outer body portion 16 of the bulk bin. For purpose of explanation only, FIGS. 9 and 10 show the formation of a typical top end cap. Note that the primary side wall flaps 42, 44, 46 and 40, 48 are initially folded over and toward the inside of the outer body member 16 before the end cap 18 is placed in position. As the end cap 18 is positioned over the primary side wall flaps, the corners thereof are folded down about the score lines 80, 81, 82 and 83 and inserted inside the secondary side walls 31, 33, 35 and 37. Subsequently, the secondary end flaps 41, 43, 45 and 47 are folded around the blunted corner ends of the end cap 18 and inserted in their respective slits 86, 85, 84 and 87 respectively. Of course, it is understood that the top end cap is not placed on the bulk bin until after it is filled and the top inside pad 21 is placed in position. Thus, once the end flaps 41, 43, 45 and 47 are inserted in their respective slots, the top pad 21 serves to aid in frictionally holding them in place. With a container loaded and closed as described, it has been found that there is no need to further secure the container with straps or the like. FIG. 11 shows an exploded, perspective view of the sequence followed in erecting the container.

From the above, it can be seen that the present invention provides an improved bulk bin container for shipping beef or pork meat products, or granular material wherein the bulk bin is used in combination with a shipping pallet and without external strapping. The addition of the pallet enables the bulk bin to be handled with a fork lift truck and the provision of being able to lock both the top and bottom caps to the outer tube without a need for strapping is a revolutionary step in bulk bin packaging.

While the preferred embodiment has been shown by way of illustration only, it should be appreciated that changes may be made in the structure as desired within the spirit and scope of the invention as defined in the appended claims.

I claim:

1. A combination pallet/bulk bin container prepared from corrugated paperboard material or the like, comprising:

(a) a pallet;

(b) a bulk bin container of generally octagonal shape positioned on top of said pallet, said bulk bin container consisting of a plurality of side walls, each of said side walls haing attached to the ends thereof primary and secondary end closure flaps; and, (c) end closure caps for said bulk bin container prepared from generally rectangular flat sheets of the container material and cut and scored to form rectangular caps and octagonally shaped caps, said end closure caps being cut and scored to accept selected ones of said primary or secondary end closure flaps internally of said container for the purpose of securing said end caps to said bulk bin container, said rectangular end caps have slits located inboard from and parallel to the side edges thereof for accepting the primary end flaps and said octagonal end caps include slits and scores at each corner thereof, said scores forming end corner flaps which are inserted inside said container and said slits forming openings inboard of and parallel to said scores for accepting the secondary end flaps wherein like closure caps or different closure caps may be secured to each end of said container.

2. A combination pallet/bulk bin container prepared from corrugated paperboard material or the like, comprising:

(a) a pallet;

(b) a bulk bin container of generally octagonal shape positioned on top of said pallet, said bulk bin container consisting of a plurality of side walls, each of said side walls having attached to the ends thereof substantially identical top and bottom primary and secondary end closure flaps;

(c) A rectangular end closure cap for the bottom of said container material, said end closure cap including a plurality of slits of a length equal to the width of said primary end closure flaps and located inboard of the side edges thereof for accepting the said primary end closure flaps at the bottom of said container thereby locking said rectangular end closure cap to the bottom of said container; and, (d) an octagonal end closure cap for the top of said container formed from a generally rectangular sheet of said container material, said end closure cap including a plurality of scores at each corner thereof which form corner flaps and give the cap its octagonal shape, and a plurality of slits of a length equal to the width of said secondary end closure flaps and located inboard of said scores for accepting the secondary end closure flap at the top of said container thereby locking said octagonal end closure cap to the top of said container.

* * * * *